US008943730B2

(12) United States Patent
Ascano

(10) Patent No.: US 8,943,730 B2
(45) Date of Patent: Feb. 3, 2015

(54) TACTICAL SUPPORT DEVICE

(71) Applicant: Nelson Ascano, Downey, CA (US)

(72) Inventor: Nelson Ascano, Downey, CA (US)

( * ) Notice: Subject to any disclaimer, the term of this patent is extended or adjusted under 35 U.S.C. 154(b) by 0 days.

(21) Appl. No.: 13/965,261

(22) Filed: Aug. 13, 2013

(65) Prior Publication Data

US 2014/0190054 A1 Jul. 10, 2014

Related U.S. Application Data

(60) Provisional application No. 61/751,091, filed on Jan. 10, 2013.

(51) Int. Cl.
*F41C 33/00* (2006.01)

(52) U.S. Cl.
CPC ..... *F41C 33/007* (2013.01); *F41C 33/008* (2013.01); *F41C 33/005* (2013.01)
USPC ..... 42/94

(58) Field of Classification Search
None
See application file for complete search history.

(56) References Cited

U.S. PATENT DOCUMENTS

| | | | | |
|---|---|---|---|---|
| 4,665,641 | A | 5/1987 | Llames | |
| 6,196,504 | B1 | 3/2001 | Lemke | |
| 6,325,258 | B1 | 12/2001 | Verdugo et al. | |
| 6,536,153 | B2 | 3/2003 | Lindsey | |
| 7,270,254 | B2 | 9/2007 | Kakouras | |
| 2007/0181627 | A1 * | 8/2007 | Simonin et al. | 224/671 |
| 2013/0276343 | A1 * | 10/2013 | Peters | 42/90 |

FOREIGN PATENT DOCUMENTS

GB 1326388 * 8/1973

* cited by examiner

*Primary Examiner* — Stephen M Johnson
(74) *Attorney, Agent, or Firm* — Daniel Boudwin; Global Intellectual Property Agency LLC

(57) ABSTRACT

A tactical support device comprising a universal butt stock clip and plate member is provided for securing and maneuvering a rifle or long gun. The clip member is attached along the rear portion of a long gun and includes an elongated rod having a rounded end termination. The rounded end is dimensioned to fit within a corresponding slot along the plate member, which is attached to the desired stowage area on the operator. The elongated rod provides an offset between the weapon and user such that there is room enough to support the weapon and perform desired activities while operating in a tactical environment. The elongated rod is supported from different clip embodiments, and alternatively is hingedly attached thereto or attached directly to the butt stock of a long rifle for use with the plate member disposed on the operator's person.

9 Claims, 9 Drawing Sheets

TACTICAL SUPPORT DEVICE

CROSS REFERENCE TO RELATED APPLICATION

This application claims the benefit of U.S. Provisional Application No. 61/751,091 filed on Jan. 10, 2013, entitled "Tactical Universal Clip." The above identified patent application is herein incorporated by reference in its entirety to provide continuity of disclosure.

BACKGROUND OF THE INVENTION

1. Field of the Invention

The present invention relates to weapons accessories. More specifically, the present invention relates to a removable retaining device that comfortably and securely fixes a long gun to any area capable of supporting the clip member. Although the long gun is adamantly secured, a rotational capability is allowed to improve reaction time when aiming the weapon, which is a highly desirable trait while operating in a tactical situation.

In a tactical environment, the ability to freely maneuver a weapon is paramount. During low risk scenarios, weapons are frequently secured on the body for quick access, yet not in a manner intended to deal with imminent threats. By positioning the weapon in such a manner, a user is not burdened by having to constantly support the weapon which inevitably causes fatigue and exhaustion. During high risk scenarios the rifle is predominantly in a ready position, enabling a user to quickly react to threats, thereby eliminating the amount of time required to transition from a non-ready stance. The efficiency with which a user can transfer between these two stages is essential to ensuring their safety and heightening the probability of a mission success.

Law enforcement and military personnel frequently utilize weapon retaining devices. In order to increase the likelihood of a successful outcome during tactical situations, a wide assortment of mission specific gear is selected, which creates a considerable burden for a user. The expenditure of energy a user undergoes during periods of transportation and mobility becomes a prominent issue in the field, necessitating the use of sizable packs and load bearing vests. These vests contain a plurality of small nylon loops that act as tie down points, allowing a user to attach hooks, straps or other such devices for the purpose of securing a piece of gear. Once all required gear is stowed, a weapon retaining device is commonly deployed to permit for even distribution of the weapon's weight thereby not causing irritation or strain. It is imperative that the weapon retaining device allows for a user to rapidly transition the weapon to a desired firing position and does not interfere with other stowed items. In a tactical environment it is imperative that weapon access is timely and unrestricted.

A sling is a commonly utilized device for carrying a weapon into a tactical scenario. A sling is an adjustable device that attaches to a long gun at two points, usually near the front and rear, thereby creating a loop. This loop can then be draped over a user's shoulder, across their torso or any other arrangement considered comfortable. Slings come in numerous configurations with variable attachment points, materials, adjustability options and other features to improve their efficiency and appeal to end users. In the field, slings contain several inherent drawbacks relating to their versatility. The material utilized to fabricate the sling may constrict a user's torso hindering a user from obtaining a critical piece of gear in a situation where rapid response is essential. Adjustable metal clips, commonly associated with slings, provide the opportunity for noise during physical activity emanating from the contact between the clip and the long gun. This can be extremely problematic during operations adhering to a strict noise discipline policy. Furthermore, a sling does not directly attach the long gun to a user; it only acts as a dampening device, transferring the weight through a type of fabric. This transference is the root cause for movement of the long gun prompting discomfort and irritability.

The present invention relates to a new and novel tactical support device that is particularly suited for supporting a tactical weapon, wherein the inherent drawbacks of a weapon sling are overcome and tactical efficiency is improved. The device allows the user to support the weapon in a stowed state while permitting rapid access thereto when transitioning between a non-ready and ready state. The device employs a largely generic means of connection to the weapon, where no special appliances are required. When deployed, the weapon is supported from the device and in close proximity to the user, without requiring user vigilance thereover. This allows the user to engage in other activities like weapon switching and other operations that are best handled with two free hands. When necessary, the user can quickly grasp the weapon and enter a ready state in a tactical situation.

2. Description of the Prior Art

Devices have been disclosed in the prior art that relate to weapon retaining devices. These include devices that have been patented and published in patent application publications. These devices generally relate to weapon retaining devices. The following is a list of devices deemed most relevant to the present disclosure, which are herein described for the purposes of highlighting and differentiating the unique aspects of the present invention, and further highlighting the drawbacks existing in the prior art.

U.S. Pat. No. 8,166,694 belonging to Swan describes a two piece weapon retaining device that comprises a first connecting member and a second connecting member. The first connecting member securely attaches to the weapon, tool or other piece of equipment while the second attaches to the desired plane deemed to support the aforementioned equipment. Although this device provides a unique method for retaining a long rifle it does not provide an adequate means for rotation and suspension as does the present invention. During physical activity the ability to freely rotate a suspended weapon provides more flexibility for a user in regards to obtaining another piece of gear attached to their person, exiting a vehicle with ease or converting from a running position to kneeling position without any unintentional interference. Another point of contention relates to the distance that the weapon is suspended relative to the plane on which the base member is secured. Swan's device provides a minimal distance thereby requiring that no gear be stowed directly adjacent to the base member to ensure no interference with the weapon. If the weapon moves in a rotational fashion during physical exertion the rifle may become tangled in an extraneous piece of gear similarly attached to a user. In a tactical situation a limited amount of time exists for a user to successfully maneuver a weapon from a stowed position to a ready position.

U.S. Pat. No. 7,270,254 to Kakouras describes a weapon sling that can be utilized over one or both shoulders. The straps are adjustable in length and contain a padded area to provide comfort to a user when deployed. This device provides a unique means to stow a weapon using straps but also contains several inherent drawbacks relating to a user's comfort and access to their weapon. By utilizing a sling there is no direct connection between a user and their weapon. The connection is transferred through the straps of the sling device that distributes the weight of the weapon to a user's body allowing for small movements to drastically affect the position of the slung weapon. Several different aspects of this device may cause complications for a user in a tactical situation. The nylon material which comprises the strap is typically routed over the shoulder in a vertical direction or diagonally from the shoulder to the small of the back. This method creates an opportunity for the strap to get caught on supplementary gear situated on a user's person, such as utility bags, backpacks, superfluous weapons, supplies and communication devices. The present invention resolves these issues by providing a direct connection between a user and the weapon while also eliminating the need for numerous straps or other material that could impede the maneuvering of an attached weapon.

U.S. Pat. No. 6,536,153 to Lindsey describes an attachment adapter for a sling that is securely positioned on the barrel end of a rifle. When a sling is deployed the adapter can be attached to a weapon at several distinct points providing a user with a weapon in either a slung capacity or a ready to fire capacity. This device provides a unique means to carry a weapon in a specific orientation while not providing the versatility of the current invention. In order to transition between predetermined weapon orientations a user must detach a clip and then reattach a clip in the desired configuration, an action that forces a user to consume valuable time. In addition, the straps needed to stabilize Verdugo's device encompass a user's shoulder and torso prompting possible interferences with other pieces of gear situated in these areas. The present invention resolves these issues by providing a quick release solution while also eliminating the need for numerous straps or other materials that could impede the maneuvering of the attached weapon.

U.S. Pat. No. 6,325,258 to Verdugo describes a tactical sling system comprising a quick release fitting. This fitting allows for a rapid transition from a stowed position to a ready to fire position. The adjustable sling contained within the system has a first end attached near the forward grip of a weapon and a second end attached to the rear end of a weapon, near the intersection of the lower receiver and butt stock. A length of webbing bridges the first and second attachment points providing additional security while the weapon is in the vertical or slung position. Additional embodiments provide the capability to attach the weapon to a backpack or load bearing vest for the purpose of stowage during transport or low risk maneuvers. This device provides a novel means to transfer between a slung position and a ready to fire position in an acceptable amount of time yet does not offer the versatility of the present invention. The adjustable straps associated with this device fully encompass a user's torso presenting an opportunity for interferences with other secured equipment Additional problems include the noise level and unintentional movement associated with Verdugo's invention. Repeated contact between the long gun and numerous metal components associated with the device creates noise, which may be detrimental to operating in a tactical environment. The sling itself does not provide a direct connection between a user and the long gun, instead it distributes the weapon's weight across a user's body whereby any physical activity performed by a user will inevitably cause movement. The present invention resolves these issues by providing a direct connection between the user and the weapon while also eliminating the need for numerous straps or other material that could impede the maneuvering of an attached weapon.

U.S. Pat. No. 4,665,641 to Llames describes an adjustable sling that is attached to the rear butt stock end of a long gun as well as the front portion whereby both attachment points have the embedded capability to swivel. This feature provides a user with the ability to rapidly maneuver and fire the weapon while in the standing, kneeling or prone positions. Although this device offers a unique method for utilizing a sling it does not provide the efficiency and flexibility as does the present invention. Slings commonly found in the art are fabricated from nylon straps that typically encompass the torso of a user for the purpose of distributing the weight of a rifle. This methodology frequently initiates frustration when a user attempts to obtain other pieces of gear suspended from his or her person. Another issue regarding Llame's device deals with repeated contact between the long gun and numerous metal components. This unintentional noise creation may be detrimental to operating in a tactical environment.

U.S. Pat. No. 6,196,504 to Lemke describes a quick release device for joining a camera and a base plate that negates any torsional twisting by locking the camera in place. Although this device provides a novel means for securely attaching a camera with a base plate it does not provide any means to secure a rifle, long gun or other piece of gear essential to maneuvers in a tactical environment. Lemke's device contains various components, one of which pertains to a clamping handle that produces an extended profile leading to possible interferences with an end user. On final inspection, Lemke's device does not contain the versatility to provide a quick release weapon retaining solution as does the current invention.

These prior art devices have several known drawbacks. The sling characteristic pertaining to a majority of these devices have an inherent stability issue, as well as a propensity to constrict a user by causing an interference with other stowed gear.

It is submitted that the present invention is substantially divergent in design elements from the prior art, and consequently it is clear that there is a need in the art for an improvement to existing weapon retaining devices. In this regard the instant invention substantially fulfills these needs.

SUMMARY OF THE INVENTION

In view of the foregoing disadvantages inherent in the known types of weapon retaining devices now present in the prior art, the present invention provides a new weapon retaining device that can be utilized for providing convenience for the user when retaining a weapon.

It is therefore an object of the present invention to provide a new and improved weapon retaining device that has all of the advantages of the prior art and none of the disadvantages.

It is another object of the present invention to provide a weapon retaining device capable of being deployed in harsh environments.

It is another object of the present invention to provide a weapon retaining device possessing a minimal form factor to reduce weight and therefore reduce strain on a user.

It is another object of the present invention to provide a weapon retaining device that securely attaches a long gun in any desired area capable of supporting the plate member.

It is another object of the present invention to provide a weapon retaining device capable of rotating along a fixed axis.

It is another object of the present invention to provide a weapon retaining device capable of supplying an adjustable offset from the mounting plane to the captured long gun.

Another object of the present invention is to provide a weapon retaining device that offers a comfortable means of transporting a long gun during both static and dynamic activities.

Yet another object of the present invention is to provide a weapon retaining device that includes a plate and clip member that, when mated, facilitate a secure connection.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
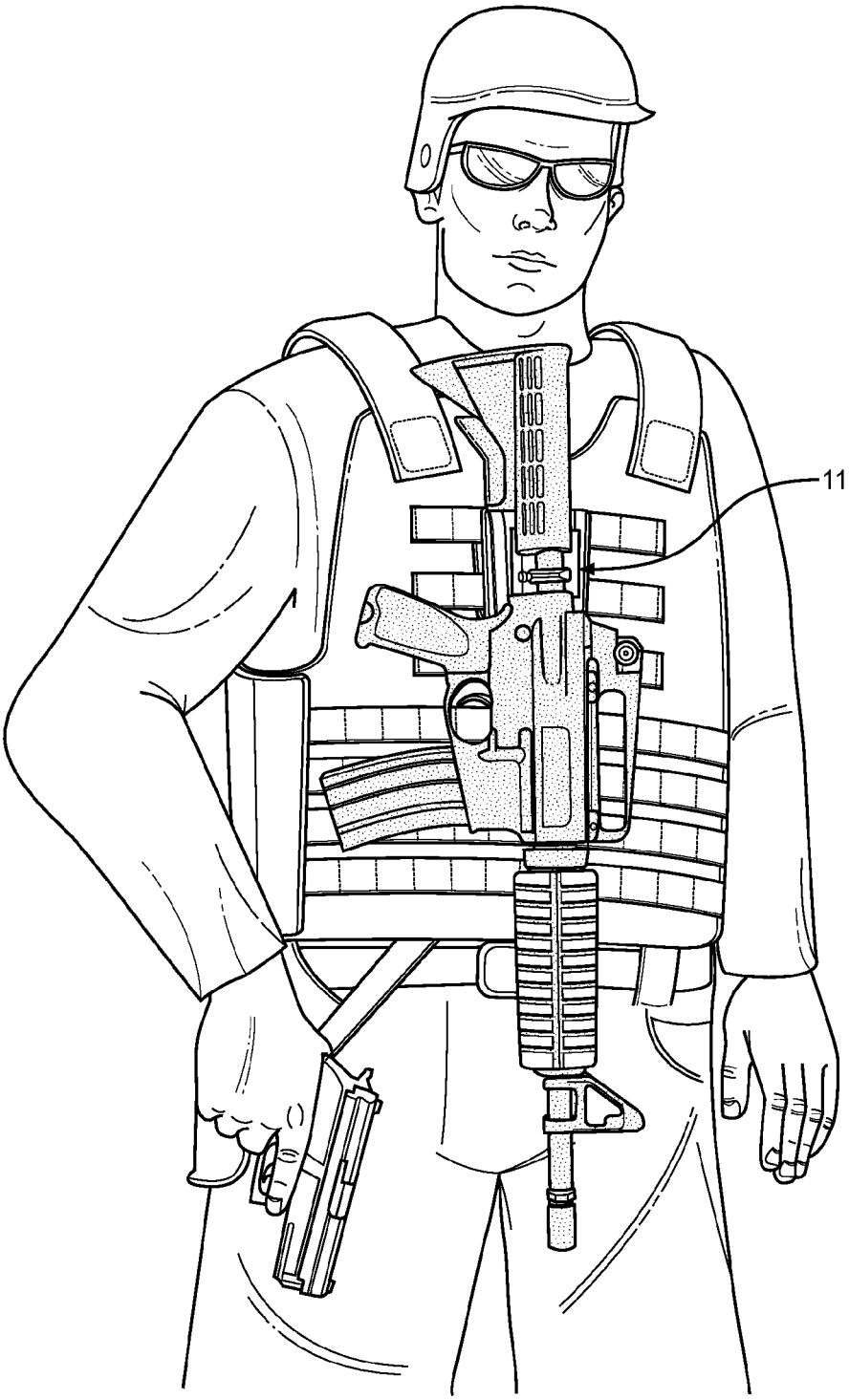
FIG. 1 shows the present invention in use, supplying a secure attachment point between a user and a rifle.

Reference is made herein to the attached drawings. Like reference numerals are used throughout the drawings to depict like or similar elements of the weapon retaining device. For the purposes of presenting a brief and clear description of the present invention, the preferred embodiment will be discussed as used for weapon retaining device. The figures are intended for representative purposes only and should not be considered to be limiting in any respect.

Referring now to FIG. 1, there is shown a frontal view of a user deploying the tactical support device 11 of the present invention to efficiently and securely stow a rifle. In the illustrated position, the rifle is situated muzzle down, allowing for unobstructed access to a sidearm as well as to adjacent gear. The weapon is capable of rotation along an internal pivot point contained within the support 11, granting a user hands free movement while supporting the weapon during periods of mobility and transport. Pouches, ammo containers, magazines, water bottles, tools, and other articles may be substituted for the displayed rifle at a user's discretion, providing additional versatility while preparing to enter a tactical environment.

Figure 2:
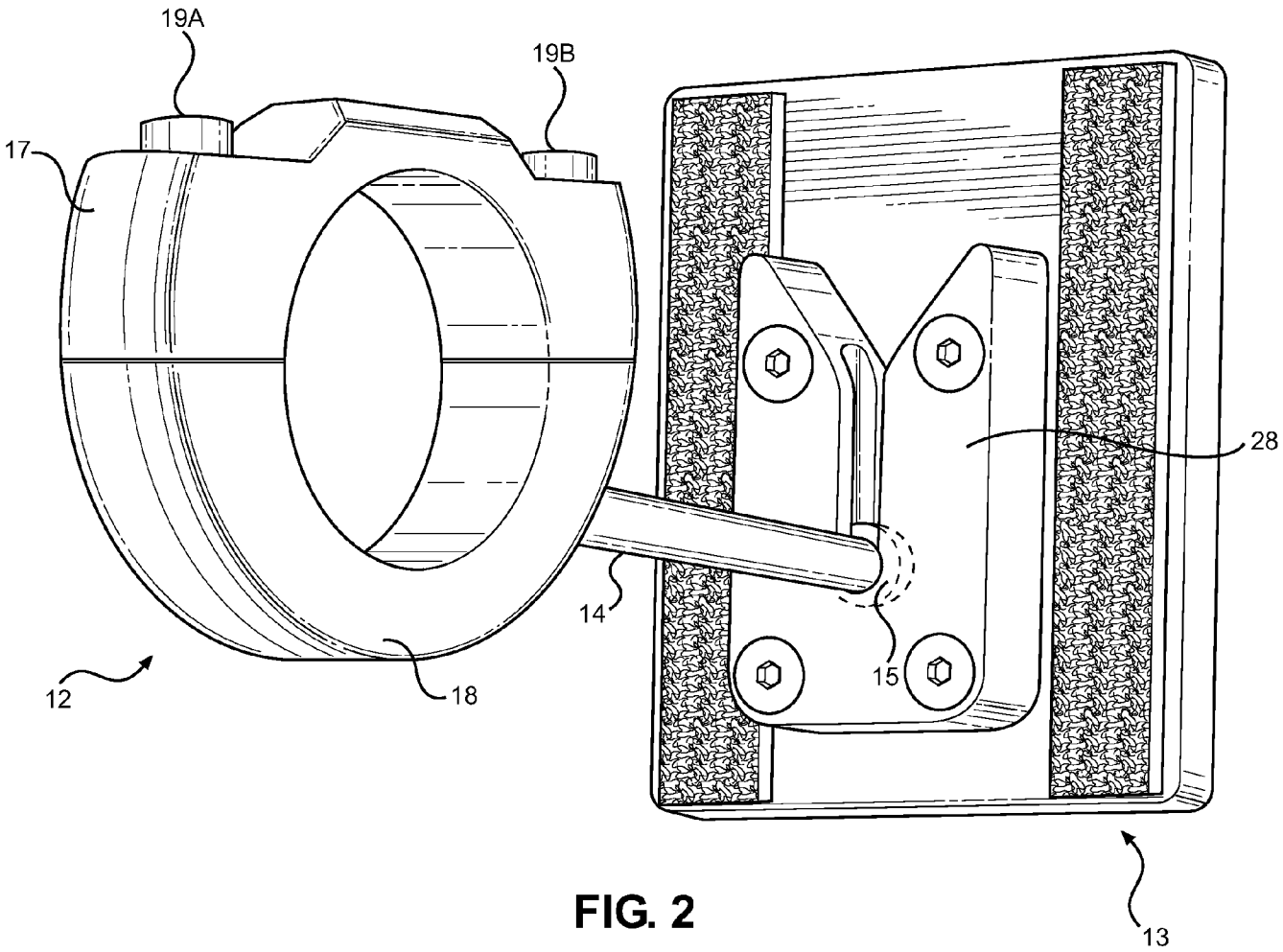
FIG. 2 shows a view of an embodiment of the clip member of the present invention in connection with the plate member.

Referring now to FIG. 2, there is shown a perspective view of the exemplary embodiment of the tactical support device 11 of the present invention in a fully assembled state. The device comprises a clip member 12 and a plate member 13 that act as a support for a rifle or similar article from the operator's person such that hands-free operations are facilitated without compromising the operator's ability to engage the weapon when needed. The clip member 12 and plate member 13 work together to form a pivotable support for a weapon such that the weapon is located in a steady position while the operator can withdraw a sidearm or engage articles with his or her hands.

In order to attach the support to a rifle, the exemplary embodiment of the clip member 12 comprises a separable upper 17 and lower 18 portion that fasten around the butt stock of the rifle. The upper portion 17 of the clip member 12 is released from its secured position against the lower portion 18 by removing two identical mechanical fasteners 19A, 19B. A user then positions the upper portion 17 of the clip member 12 about the desired perimeter of butt stock where attachment of the clip member 12 is desired. The lower portion 18 of the clip member 12 is then situated along an opposing side of the butt stock, wherein two threaded holes of the lower portion 18 align with through holes of the upper portion 17 for mechanical fastening. An elongated rod 14 extends from the clip lower portion 18 and is positioned to extend outward and optionally slightly downward to facilitate capture of its end termination 15 by the slotted cutout found on the receptacle plate 28 of the plate member 13. The aforementioned fasteners 19A, 19B may be substituted for other attachment means such as clamps, plungers or other mechanical devices common to the art. The lower portion 18 may also be attached to the upper portion 17 with a locking hinge joint installed on the section of frame opposite the elongated rod 14. A hinge would eliminate the flat mating surface between the clip upper and lower portions, as well as the corresponding mechanical fasteners.

The plate member 13 includes a slotted receptacle plate 28 that is adapted to accept the end termination 15 of the elongated rod 14 and provide rotatable support for the rod and the weapon attached thereto. The rod 14 is capable of rotation about its longitudinal axis only and is locked in a given outward orientation with respect to the plate receptacle plate 28. This allows the attached weapon to rotate in a single plane and be offset a given distance from the operator for hands free carriage of the weapon and ready engagement thereof when required.

Figure 3:
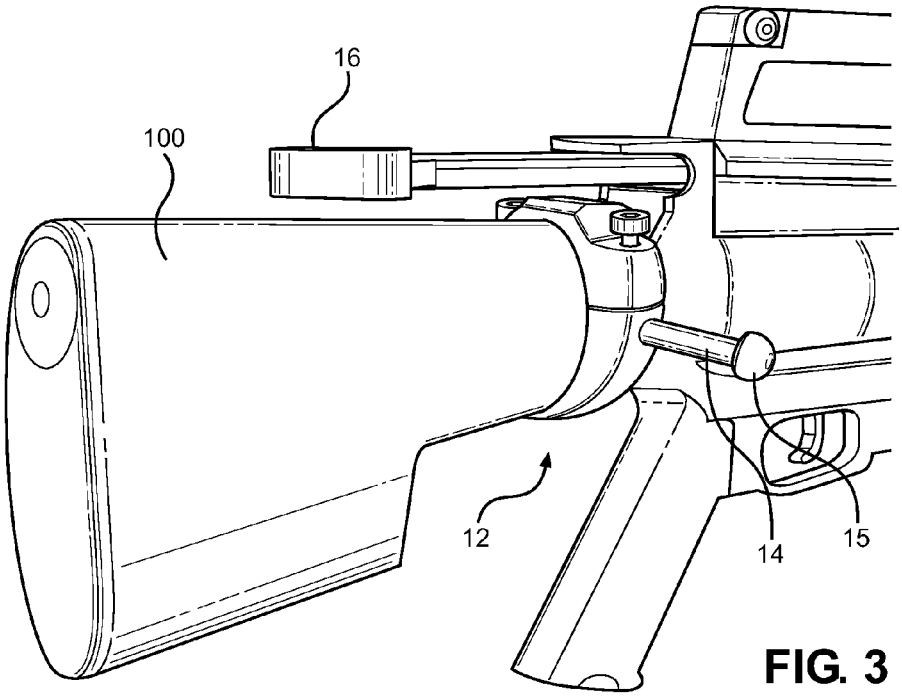
FIG. 3 shows an embodiment of the clip member of the present invention deployed on a rifle butt stock.

Referring now to FIG. 3, the clip member 12 of the present invention is shown being deployed on the butt stock portion of a rifle. The clip member 12 may be formed with an elliptical profile, which includes an elongated rod 14 extending therefrom that culminates in a rounded or semi-spherical termination 15 at its distal end. The rod 14 can vary in size to accommodate different suspension distances, providing adequate clearance for larger rifles with custom modifications. In the current configuration, the rod 14, end termination 15 and lower portion of the clip member 12 are fabricated as a singular unit, yet the rod 14 may be removable through the use of a mechanical fastener that would protrude through the internal diameter of the clip member 12 and capture a corresponding threaded portion located on a flat mating surface of the rod 14. This connection would provide the compression force necessary for securement while not introducing interference between the long gun and clip member when deployed. On the top plane of the clip member 12, there exists a flat mating surface flanked by two mechanical fasteners. This feature exists to provide adequate clearance for the translation of the charging handle 16 toward the rear of the rifle negating any possible interference that may occur. The elongated rod may also have a removable, threaded connection to the clip lower portion.

Figure 4:
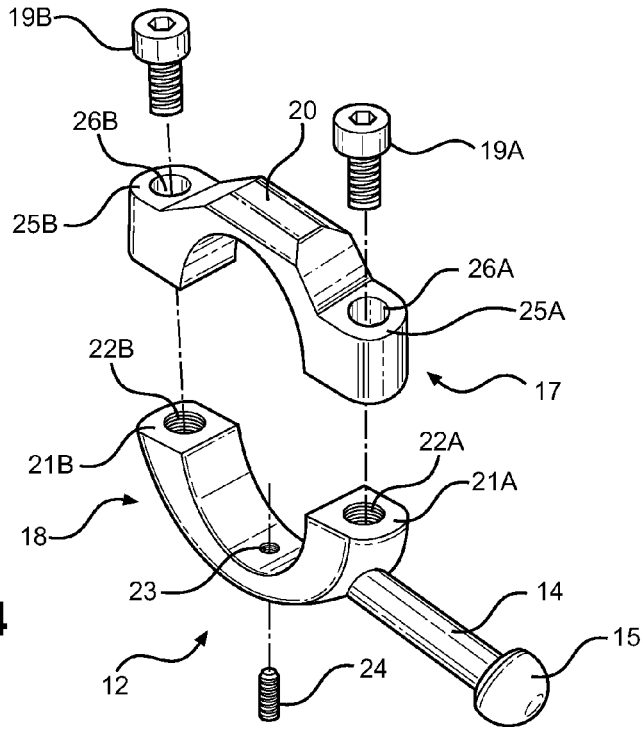
FIG. 4 shows a perspective exploded view of an embodiment of the clip member.

Referring now to FIG. 4 there is shown the clip member 12 of the present invention in an open configuration, establishing the abutting connection between the upper 17 and lower 18 clips portions. The lower portion 18 includes a rounded or elliptical cut-out having a concave profile that terminates along a plane defined by a flat mating surface 21A, 21B. The flat surfaces 21A, 21B both contain identical threaded apertures 22A, 22B that directly correspond with the threads of the mechanical fasteners 19A, 19B. Once the mechanical fasteners extend beyond the through holes 26A, 26B of the upper portion 17, they are mated with the threaded apertures 22A, 22B, thereby producing the clamping force required to secure the upper 17 and lower 18 portions together. Emanating from the outside surface of the lower portion 18 is an elongated rod 14 that extends outward from the lower portion 18 and alternatively at a slightly downward angle relative to the aforementioned flat mating surfaces 21A, 21B. The rod 14 end includes an end termination 15 that is adapted to be accepted by the slotted plate member of the present invention against the user. This end member 15 is be free of sharp edges and burrs in order to minimize unintentional interferences. At the lowest point in the concave section of the lower portion 18 there exists a set screw aperture 23 for installing a set screw 24. This aperture 23 may be fabricated from tapping threads or installing a helical coil insert. The upper portion 17 of the clip comprises of a corresponding elliptical internal cut-out relative to the lower portion 18 with a flat mating surface 20 on the external top plane. The edges adjacent to the top plane are chamfered to relieve any interference during assembly wherein a flat mating surface 25A, 25B stands prominent on both lateral ends to provide a parallel plane, relative to the flat mating surface 21A, 21B of the lower portion 18, to install the intended mechanical fasteners 19A,19B. The mechanical fasteners 19A, 19B are secured to this plane which inherently sits below the top plane of the upper portion 17 and therefore below the charging handle of a rifle 16.

A secondary membrane may exist on the internal diameter of the clip member to further expand the flexibility of the present invention. The butt stock portion of a long gun can vary across different manufactures and models, thereby providing in inconsistent fit. A buffering, membrane member can be deployed to negate any dimensional fluctuations regarding the diverging profiles, thereby maximizing the effectiveness of the present invention in the field and across the firearm industry. Materials such as, but not limited to, rubber, foam and silicone display desirable characteristic for operating continually in harsh environments and contain the necessary durometer suitable to avoid failure after repeated usage.

Figure 5:
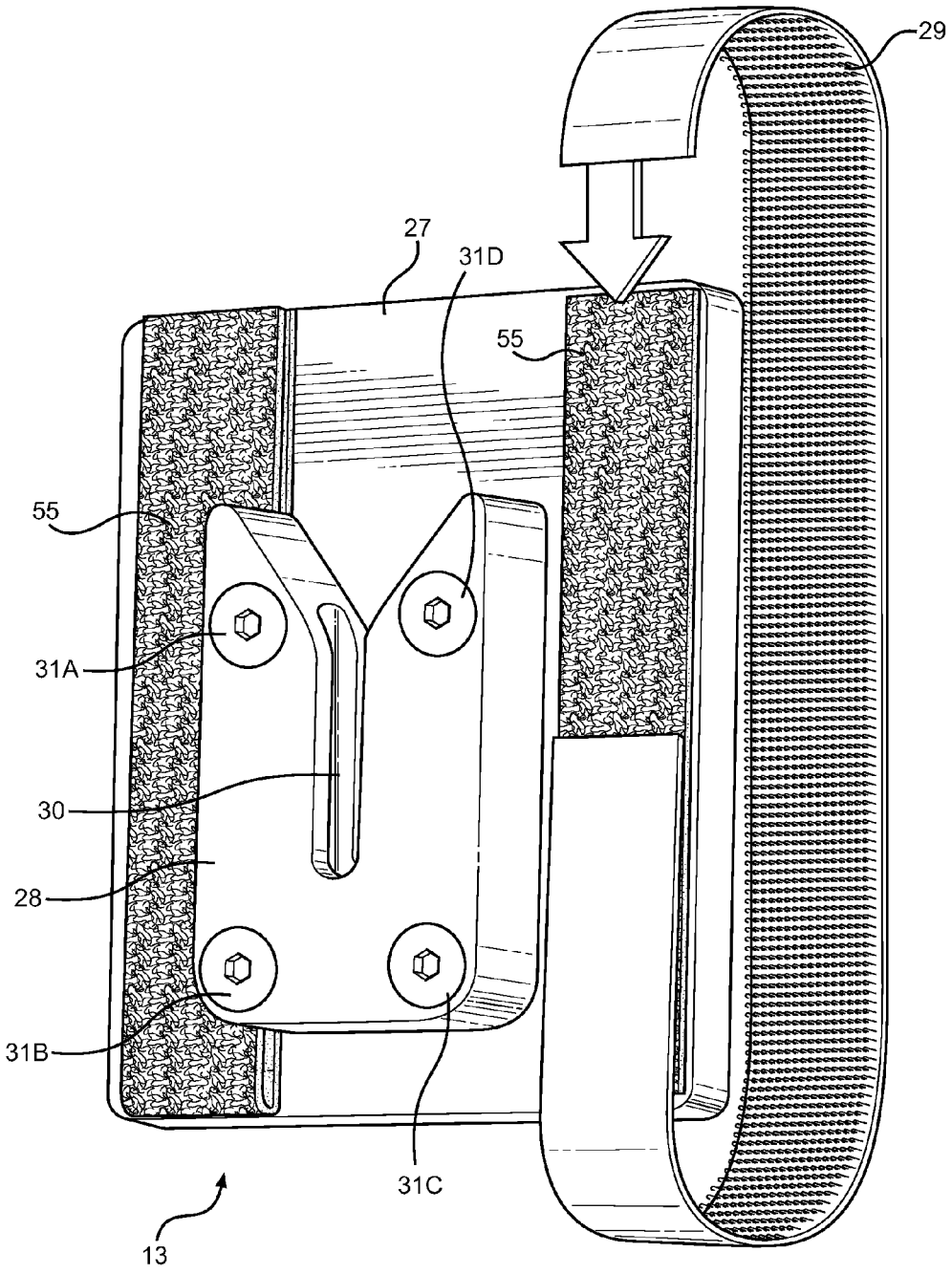
FIG. 5 shows a frontal perspective view of the plate member and a preferred attachment means therefor.

Referring now to FIG. 5. there is shown the plate member 13 of the present invention. The plate member 13 comprises a base plate 27, a receptacle plate 28, and a means 29 for attaching the plate member. The base plate 27 acts as the main body of the plate member and is responsible for transferring the downward force acted upon the receptacle plate 28 to the plane where the base plate 27 is secured. The receptacle plate 28 is secured along the center of the base plate 27 and is secured by a plurality of mechanical fasteners 31A, 31B, 31C, 31D. In this embodiment two plates are utilized to constitute the plate member 13, yet a single integrated base and receptacle plate may be substituted if deemed appropriate.

The receptacle plate 28 is responsible for securing a positive capture of the end termination of the clip member and contains a front wall, rear wall, bottom wall, a pair of side walls and a partial top wall. Material is strategically removed from the top and front wall of the receptacle plate in an inverted triangular shape. This reduction in material begins adjacent to both lateral edges of the top wall before symmetrically converging on the center plane of the receptacle plate forming a cradle like feature. Once a suitable distance is reached that is dimensioned to encompass the diameter of the end termination of the clip member the removal ceases to translate towards the center plane and transfers towards the bottom wall of the receptacle plate member forming an elongated slot 30. The inverted and triangular shaped upper of the receptacle plate 28 and the rounded top edges thereof are utilized to negate any misalignment with the corresponding clip member during assembly, thereby substantially decreasing insertion and release times and facilitating capture of the clip member without visual confirmation.

The front wall of the plate member 13 comprises an attachment means to secure the plate to an area designated against the user for stowing the attached gear or in the present case, a rifle. In FIG. 5, a strap 29 having fully integrated hook and loop 55 fasteners are visualized to accomplish this and to act as the attachment means, yet a swivel clip, fixed clip, detachable clip or any other clamping method commonly found in the art may be substituted if deemed more efficient or cost effective. The hook and loop fasteners 29 are attached to the front wall of the base plate 27 and provide a length of material capable of looping around the perimeter of the rear wall of the plate member until securing onto itself.

Figure 6:
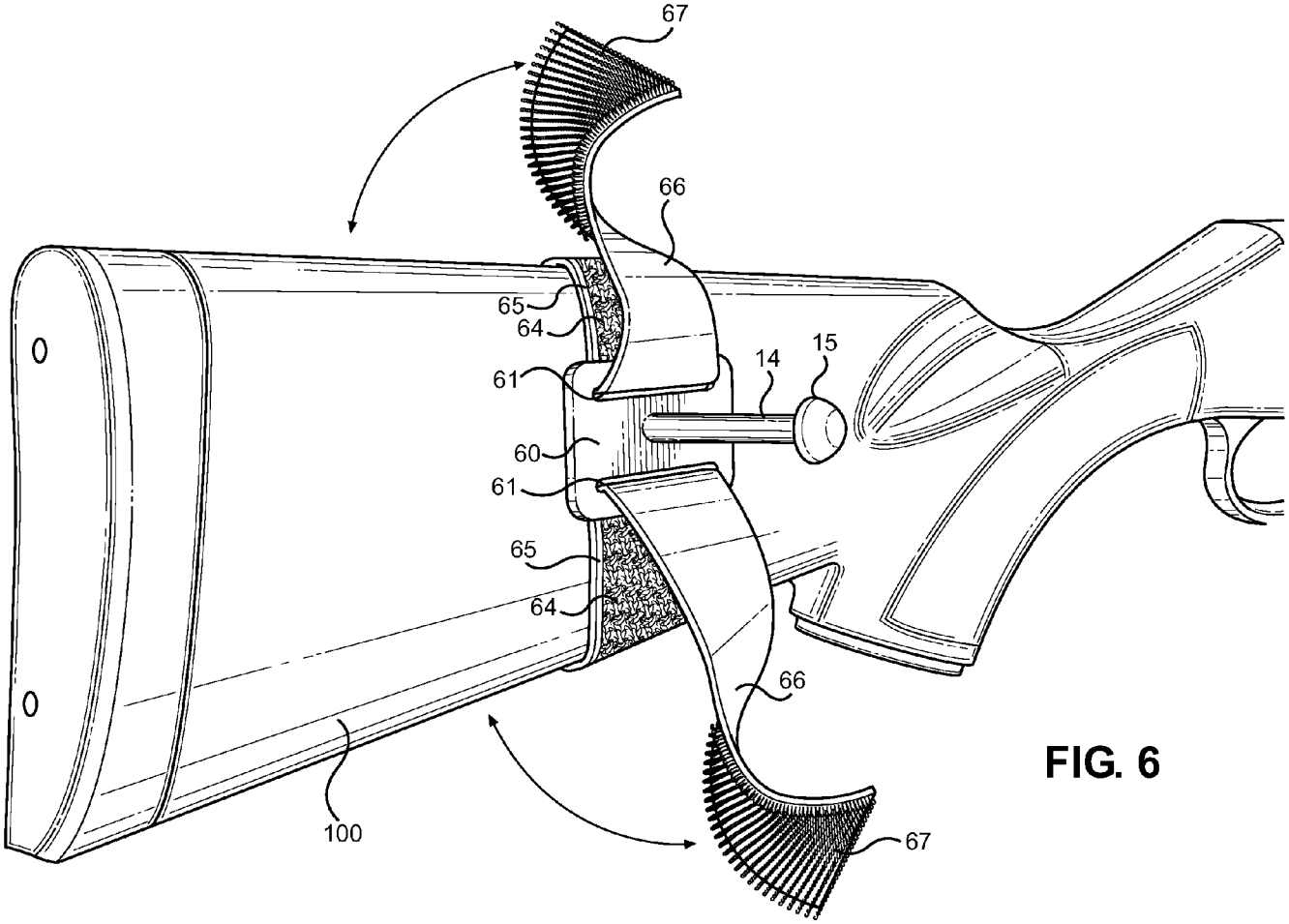
FIG. 6 shows a view of an alternate embodiment of the clip member, which includes a universal strap connector for a rifle butt stock.

Referring now to FIG. 6, there is shown a view of an alternate embodiment of the present invention in which a universal butt stop attachment means is provided. This embodiment, rather than a clip member, contemplates a strap 66 that can secure around the butt stock 100 of a weapon and attach to itself while securing a mounting plate 60 thereto. The mounting plate 60 supports the elongated rod 14 from the butt stock 100 such that its end termination 15 can engage the plat member attached to the operator. In one of the strap embodiments, the strap 66 is a singular length having loop-type 64 and hook-type 67 fasteners attached along the same surface thereof. The strap 66 engages through strap slots 61 in the mounting plate 60 and doubles back onto itself to mesh the hook and loop fasteners of the strap 66 together. A length 65 of the strap therefore clamps to the butt stock 100 of the weapon and is tensioned therearound, preventing any sliding motion of the mounting plate 60 and thus the rod 14 when suspended from the user. Other embodiments of the strap 66 contemplate multiple strap lengths that achieve the same goal: tensioned strap attachment around the butt stock 100 of the weapon, whereby the strap or straps provide for universal fitment.

Figure 7:
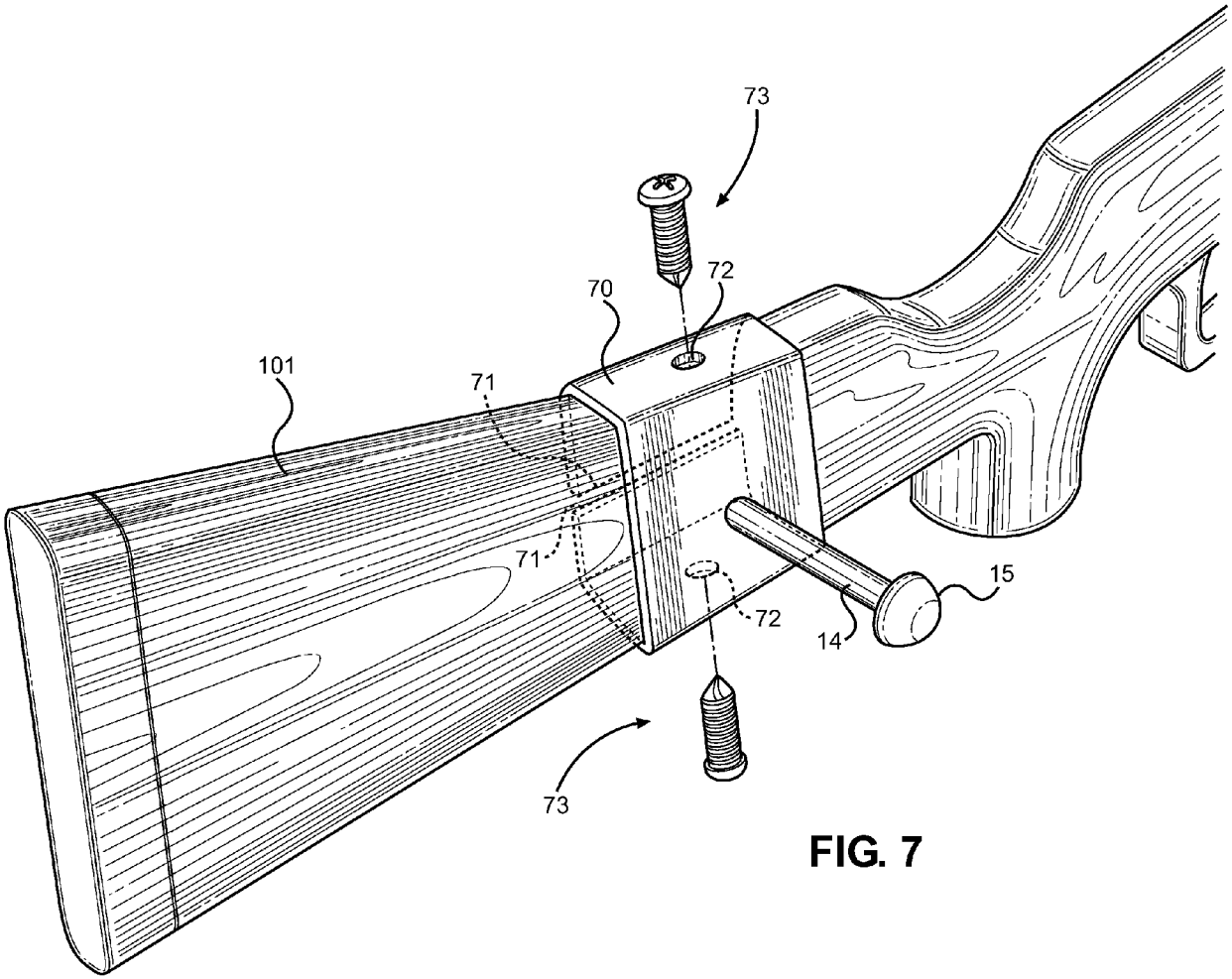
FIG. 7 shows a view of another embodiment of the clip member, which can be deployed on wooden butt stocks and mechanically fastened thereto.

Referring now to FIG. 7, there is shown yet another embodiment of the present invention, wherein a material strap 71 is fastened to the butt stock 101 of a weapon. In this embodiment, the strap 70 is preferably a durable material such as leather or plastic, and the butt stock 101 is a wooden material (e.g. AK-47 and the like). A mechanical fastener 73 is driven into the wooden butt stock 101 through apertures 72 in the material strap 71. Supported from one side of the strap 71 is the elongated rod 14 and end termination 15. The strap 71 may comprise a continuous loop or be C-shaped, wherein end strap terminations 71 are aligned along the butt stock 101 opposite the extended rod 14, whereby the mechanical fastener secures the strap 70 in place.

Figure 8:
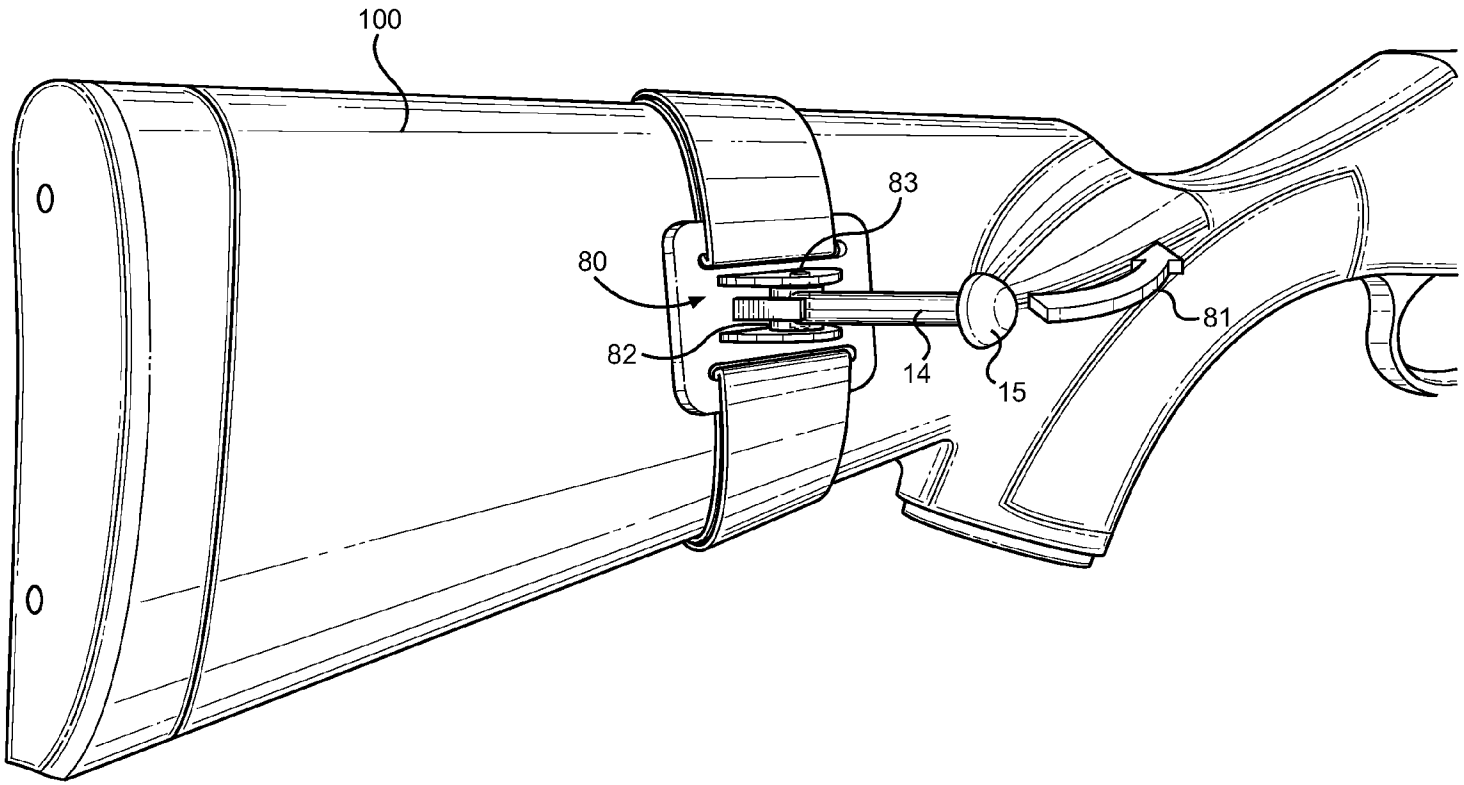
FIG. 8 shows a view of an embodiment of the clip member in which the elongated rod is pivotable from the clip body.

Referring now to FIG. 8, there is shown an embodiment of the elongated rod 14, wherein its connection with the clip member, the mounting plate, or the material strap is one that comprises a pivot joint 80. The pivot joint 80 allows the rod 14 and its end termination 15 to be rotated forward 81 to stow the same when not desired. A tab 82 along the trailing side of the joint prevents rotation backward, thus allowing the rod 14 to remain horizontal when attached to the plate member and thus allowing for normal use in its extended position. When the operator does not require the rod 14, the rod 14 can be pivoted forward 81 against the butt stock 100 for a stowed configuration. This prevents the rod 14 from getting in the way of weapon use in the ready position and prevents the user from be pressed therewith while the weapon is in use. The pivot joint 80 includes a pinned connection 83 with the base of the rod 14, wherein the rearward tab 82 limits the degree of freedom of the rod 14 purely forward rotation 81 or outward extension thereof (as illustrated in FIG. 8). The tab 82 limits the sweep of the rod 14 to only rotate forward, while the hinge pin 83 of the pivot joint limits rotation in a single plane.

Figure 9:
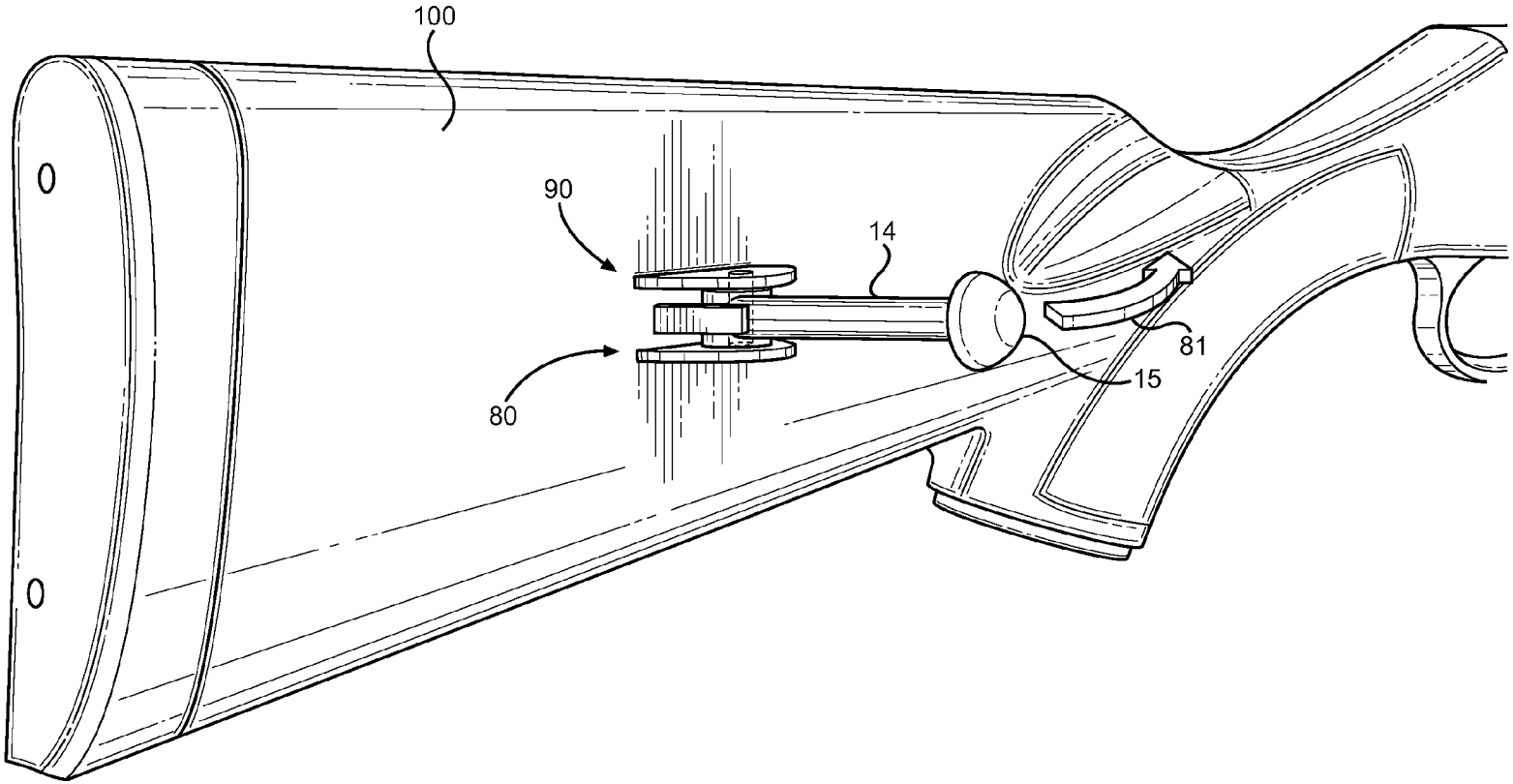
FIG. 9 shows a view of yet another embodiment wherein the elongated rod is integrated into the butt stock of the weapon, wherein the rod may be pivotably or statically connected thereto.

Referring now to FIG. 9, an embodiment of the present invention is shown wherein the elongated rod 14 is permanently attached to the butt stock 100 of the weapon. This embodiment may include a cantilevered rod 14 configuration, or alternatively the rod 14 may be attached by way of a pivot joint 80. The pivot joint is therefore permanently secured 90 to the butt stock 100 and the rod 14 is rotatable with respect thereto as previously described in FIG. 8 (forward direction 81 only). This embodiment contemplates integration of the rod into a weapon manufacturer's design or into the design of a butt stock 100 manufacturer.

Figure 10:
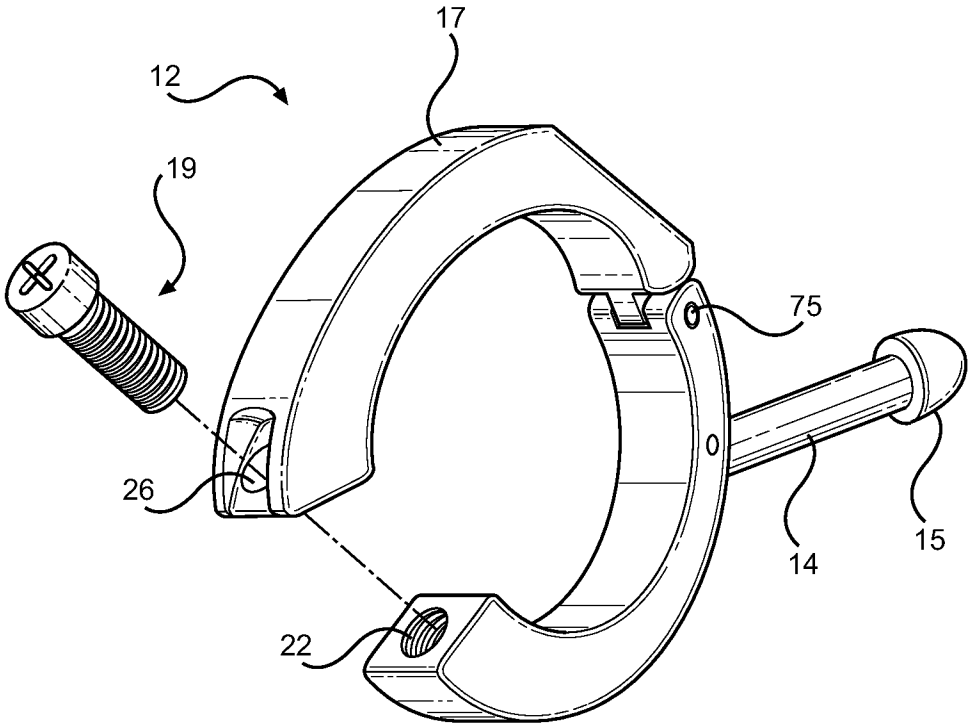
FIG. 10 shows an embodiment of the clip member in which a hinge joint is disposed thereon for separating the upper and lower portions.

Referring now to FIG. 10, there is shown an alternate embodiment of the clip member 12 of the present invention. This embodiment contemplates an upper 17 and lower 18 clip portion that are hinged 75 together and pivotable from one end thereof. The unpinned end of the portions is adapted to be mated together via a mechanical fastener 19 or other suitable attachment means. The mechanical fastener 19 slides through an aperture 26 in the upper portion and into a threaded aperture 22 in the end of the lower portion 18 to clamp the open end of the clip member 12 together about the butt stock of a weapon. As with the exemplary clip member embodiment, the elongated rod 14 and end termination 15 extends from the clip lower portion 18 for engaging the slotted plate member.

Figure 11:
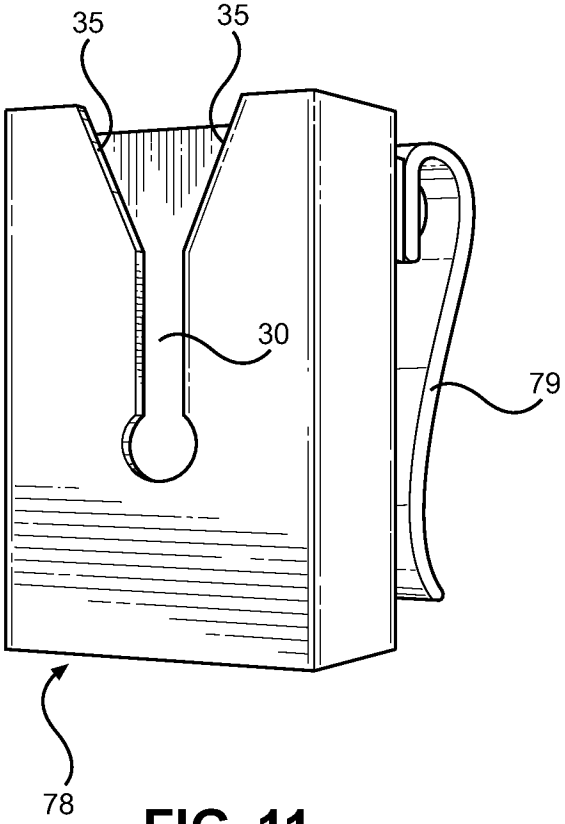
FIG. 11 shows an embodiment of the plate member, wherein the plate member can be clipped to an operator's gear.

Referring finally to FIG. 11, there is shown an embodiment of the slotted clamp member 78, wherein the clamp member is secured to an operator by way of a rear-mounted clip 79 that is open at one end and secured to the backside of the clamp member 78 along a second end. The plate member 78 includes the elongated slot 30 and triangular opening 35 of the preferred embodiment for catching and engaging the end termination 15 of the elongated rod. This engagement results in a rotational joint whereby a weapon can be suspended from a user and pivot in a single plane with respect to the joint.

When positive capture of the clip member end termination is achieved, the clip member and the attached hardware (e.g. a rifle) are rotatably supported from the plate member and no further action is required by the user to maintain its position against his or her body. The clip member is placed in an opportune location along the butt of the rifle such that the center of gravity of the rife draws the rifle barrel downwards and in a stowed state. The user is free to use his or her hands and ambulate without addressing the rifle resting against the user's body. The rotational connection further allows the user to rotate the weapon into a ready state with supreme efficiency, while further accommodating close-proximity warfare where short action and quick access to fire power is required. Overall, the device replaces the need for a traditional rifle slings and greatly improves operational capabilities of the foot solider.

Materials associated with the fabrication of the clip and plate members are commonly known to maintain the necessary standards for continual work in harsh environments, particularly during periods of mobility and transport when in tactical environments. A list of materials meeting these stringent requirements includes, but is not limited to plastics, nylon, metal, composites and corrosion resistant steel. The exact design of the clip member may take on several forms to match different butt stock designs, while the elongated rod may include different lengths and thicknesses for different applications. The elongated rod may also be removably connected to the clip member in one contemplated embodiment to accommodate different weapons or for replacement of individual components of the present invention.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tactical support device, comprising:

a clip member comprising an upper portion, a lower portion, and an open interior;

said upper and lower portions adapted to be separable and clamp securely around an article;

said upper portion and lower portion comprising a flat mating surfaces, said flat mating surfaces adapted align said upper and lower portion;

an elongated rod extending outwardly from said lower portion and having a rounded end termination;

said upper portion and said lower portion comprising at least one removable connector through said flat mating surfaces adapted to operably secure said upper and lower portions together;

a plate member comprising an elongated slot and a plate member fastener adapted to support said plate member from an operator;

said elongated slot being adapted to receive said rounded termination of said elongated rod therein, wherein said rod is supported therefrom and rotatable about the longitudinal axis of said rod.

2. The tactical support device of claim 1, wherein said upper portion and lower portion removable connector further comprises:

a first and second through hole through said upper portion;

a first and second threaded aperture adapted to align with said first and second through hole when said upper and lower portion mating surfaces are joined;

a first and second threaded fastener adapted to secure said upper and lower portions together and clamp said mating surfaces together.

3. The tactical support device of claim 1, wherein said upper portion and lower portion removable connector further comprises:

a hinge joint pivotably connecting said upper portion and lower portion at one end;

a through hole through a mating surface on said upper portion opposite said hinge joint;

a threaded aperture through a mating surface on said upper portion opposite said hinge joint;

a threaded fastener adapted to secure said upper and lower portions together and clamp said mating surfaces together opposite said hinge joint.

4. The tactical support device of claim 1, wherein said elongated rod is removably connected to said lower portion of said clip member.

5. The tactical support device of claim 1, wherein said elongated rod is pivotably connected to said lower portion of said clip member.

6. The tactical support device of claim 5, wherein said rod pivotable connection further comprises a hinge pin and a tab that facilitates rotation in a single plane and in a limited sweep.

7. The tactical support device of claim 1, wherein said plate member elongated slot further comprises a triangular open upper adapted to be wider than said elongated rod end termination and taper inward.

8. The device of claim 1, wherein said lower portion of said clip member further comprises a threaded aperture adapted to accept a set screw therethrough that protrudes into said open interior.

9. The device of claim 1, further comprising a membrane member adapted to be positioned within said clip member open interior.

* * * * *